US009821546B2

(12) United States Patent
Schaafsma et al.

(10) Patent No.: US 9,821,546 B2
(45) Date of Patent: Nov. 21, 2017

(54) DIGITAL CLICHE PAD PRINTING SYSTEM AND METHOD

(75) Inventors: Christopher T. Schaafsma, Wheaton, IL (US); Christopher J. Sobaszek, Orland Park, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1141 days.

(21) Appl. No.: 12/685,247

(22) Filed: Jan. 11, 2010

(65) Prior Publication Data

US 2010/0175571 A1 Jul. 15, 2010

Related U.S. Application Data

(60) Provisional application No. 61/144,329, filed on Jan. 13, 2009.

(51) Int. Cl.
*B41F 17/00* (2006.01)
*B41C 1/00* (2006.01)

(52) U.S. Cl.
CPC ..... *B41F 17/001* (2013.01); *B41C 1/003* (2013.01)

(58) Field of Classification Search
USPC ..... 101/41, 42–44
See application file for complete search history.

(56) References Cited

U.S. PATENT DOCUMENTS 4,803,922 A 2/1989 Dennesen
5,408,926 A 4/1995 Alder
5,511,477 A 4/1996 Adler et al.
5,662,041 A 9/1997 Kleist
6,129,012 A 10/2000 Dietz et al.
6,276,266 B1 8/2001 Dietz et al.
6,314,880 B1 11/2001 Lampinski
6,363,849 B1 4/2002 Philipp
(Continued)

FOREIGN PATENT DOCUMENTS

CN 1317407 A 10/2001
DE 19531157 2/1997
(Continued)

OTHER PUBLICATIONS

International Search Report and Written Opinion of the International Searching Authority issued in connection with PCT/US2010/020716 dated Mar. 22, 2010.
(Continued)

*Primary Examiner* — Justin Olamit
(74) *Attorney, Agent, or Firm* — Levenfeld Pearlstein, LLC

(57) ABSTRACT

A digital cliché pad printing system includes a conveyor for conveying a substantially non-elastic support medium, a material deposition jetting device for depositing a curable material onto the support in a desired pattern, the desired pattern having at least one void space, means for curing the material in the desired pattern, the cured material defining a cliché having a top surface, an ink delivery system for depositing ink in the at least one void space and for wiping ink from the top surface and a pad configured to contact the cliché to transfer ink from the void space to the pad the pad also configured to move into contact with an object to which the ink is transferred. A digital cliché media and method are also disclosed.

7 Claims, 1 Drawing Sheet

(56) References Cited

U.S. PATENT DOCUMENTS

| | | | | |
|---|---|---|---|---|
| 7,210,405 | B2 | 5/2007 | Hessert et al. | |
| 7,589,868 | B2 * | 9/2009 | Velde et al. | 358/3.3 |
| 2006/0054040 | A1 | 3/2006 | Daems et al. | |
| 2007/0144364 | A1 | 6/2007 | Hitchcock | |

FOREIGN PATENT DOCUMENTS

| | | | |
|---|---|---|---|
| DE | 19531157 | A1 | 2/1997 |
| EP | 0641648 | | 3/1995 |
| EP | 0641648 | A1 | 3/1995 |
| EP | 1437882 | A1 | 7/2004 |
| JP | 56113456 | S | 9/1981 |
| JP | 62228812 | A | 12/1987 |
| JP | 03114867 | A | 5/1991 |
| JP | 2002264295 | A | 9/2002 |
| JP | 2006159649 | A | 6/2006 |
| JP | 200798617 | A | 4/2007 |
| JP | 200893904 | A | 4/2008 |
| JP | 2008149508 | A | 7/2008 |
| WO | 9824630 | A1 | 6/1998 |
| WO | WO 2007089590 | A2 * | 8/2007 |

OTHER PUBLICATIONS

Supplementary European Search Report for EP 10731992 dated Jul. 13, 2012.

Supplementary European Search Report for EP 10 73 1992, dated Jul. 25, 2012.

* cited by examiner

DIGITAL CLICHE PAD PRINTING SYSTEM AND METHOD

CROSS-REFERENCE TO RELATED APPLICATION

This application claims the benefit of priority of Provisional U.S. Patent Application Ser. No. 61/144,329, filed Jan. 13, 2009, entitled "DIGITAL CLICHE PAD PRINTING SYSTEM AND METHOD".

BACKGROUND OF THE INVENTION

The present invention relates to pad printers. More particularly, the present invention relates to a digital cliché pad printing system and method.

Pad printing systems are used to apply high quality print, e.g. indicia. Pad printing systems use a deformable pad which receives ink, transferred as an image, from a cliché plate. The plate has an etching or engraving of the indicia formed therein. The image is transferred from the pad to the item onto which the indicia is applied.

These systems work well to produce high quality image transfer and for transferring images onto flat, as well as textured and non-planar surfaces. One drawback to the pad printing method is that cliché plates are expensive to fabricate, e.g., prepare, etch, and mount. As such, short run or single run printing is cost prohibitive using a pad printing method.

Digital systems (e.g., laser or ink jet printing) are often used for short run or single run printing due to the flexibility of these systems. These methods lend themselves well to short run and single run printing because printing commands such as image shapes are purely machine controlled. Accordingly, much lower costs are incurred in changing over the image to be printed or transferred.

It has been found that digital printing is however, limited in practical application to symmetrical shapes (e.g., spheres, cones, cylinders) or to flat or near-flat applications that allow the print head to remain within a narrow stand-off distance from the surface of the object (typically within a distance of about 0.5 to about 2.5 mm).

Other solutions to enable the flexibility of digital printing in a pad system include directly jetting ink onto the printing pads which is then transferred onto the object surface. It has however been found that inks that "jet" are not well suited for pad transfer, and often smudge or smear resulting in unacceptable image transfer.

Accordingly, there is a need for a digital cliché pad printing system and method. Desirably, such a system and method permit the use of a cliché in single run and short run printing applications. More desirably, such a system and method provide high quality image transfer without the costs associated with conventional cliché preparation.

SUMMARY OF THE INVENTION

A digital cliché pad printing system includes a conveyor for conveying a substantially non-elastic support member, a fluid jetting device for jetting a curable fluid onto the support in a desired pattern and means for curing the fluid in the desired pattern. The pattern has at least one void space and the cured fluid defines a cliché having a top surface.

An ink delivery system deposits ink in the at least one void space and wipes ink from the top surface of the cliché. A printing pad is configured to contact the cliché and transfer ink from the void space to the pad. The pad is further configured to move into contact with an object to which the ink is transferred. In a present embodiment, a controller controls the fluid jetting device.

A contemplated cliché forming fluid is UV curable and the means for curing the fluid is a UV energy source.

In one embodiment, the support member is an elongate flexible element. The system can including a dispenser for dispensing the support member and a take up for taking up the support member following printing.

The ink delivery system can include an ink cup and a doctor blade for delivering ink to the cliché and depositing ink in the at least one void space, and for wiping excess ink from the cliché.

A digital cliché media and a method for pad printing are also disclosed.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
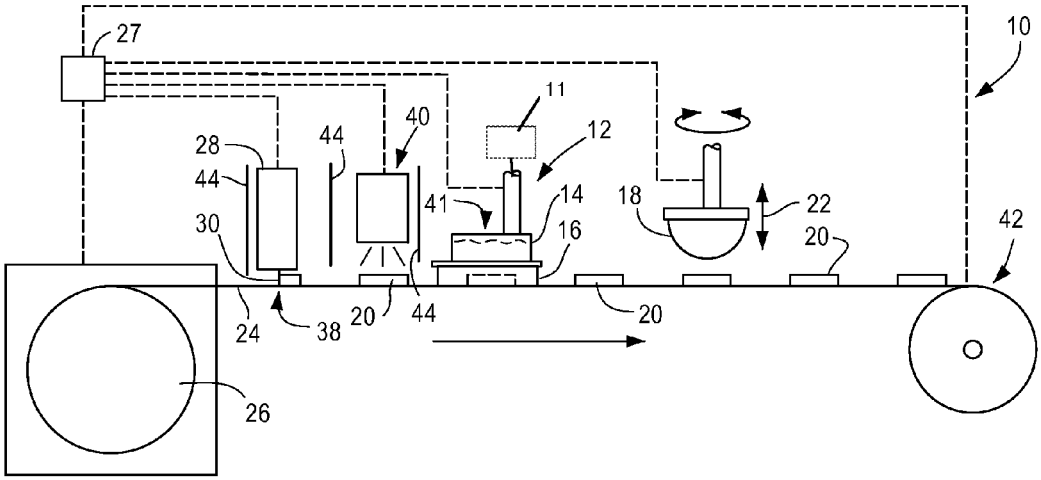
FIG. 1 is a schematic illustration of an embodiment of a digital cliché pad printing system embodying the principles of the present invention, the cliché being illustrated in partial cross-section to show the void spaces therein.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to FIG. 1 there is shown a schematic illustration of a digital cliché pad printing system 10. The illustrated system 10 includes various components of a conventional pad printing system, including a supply 11 of ink 12, an ink cup 14 with a doctor blade 16 and a printing pad 18. The pad 18 is a resilient member the moves into contact with an inked image-containing member (typically a cliché 20 and referred to herein as a cliché or an image-containing member) and picks up the image from the cliché 20. The pad 18 is resilient so that it can transfer the image, in total, onto a non-planar surface.

In a typical arrangement, the pad 18 reciprocates (as indicated at 22) to move into contact with the image-containing member 20 and away from the image-containing member/cliché 20. Various configurations can be used to then move the pad 18 into contact with an object onto which the image is to be transferred. One arrangement is illustrated in Hessert et al., U.S. Pat. No. 7,210,405, commonly assigned with the present application and incorporated herein by reference.

Unlike known pad printing systems, the present system 10 uses a digitally-created cliché 20. It enables the decoration of complex contoured shapes, symmetric shapes, near flat shapes and flat shapes, and any other shape that can be decorated using a conventional pad printing process.

In a present embodiment, the cliché 20 is created on a supporting medium/media 24, preferably a flexible, transportable supporting media, such as a paper tape, foil, polymeric material or the like. The supporting media 24 is dispensed from a supply 26, such as a roll.

Figure 2:
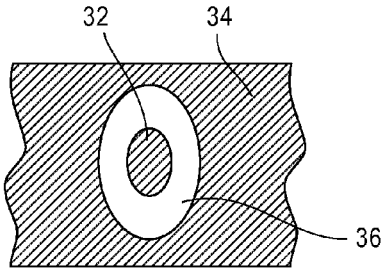
FIG. 2 is an exemplary letter "O" formed in accordance with the principles of the present invention and provided for explanatory purposes.

As with other digital systems that use a controller 27, such as a machine (computer) controller, the supporting media 24 is presented to a fluid jetting device 28 or the like, such as, or similar to, an ink jetting device. A cliché-forming material 30, such as a fluid and/or ceramic-based material, is expressed from the jetting device 28 onto the supporting media 24. Unlike conventional printing systems, in the present digital cliché system 10, the cliché-forming material 30 is jetted in the image of the negative space 36 (see FIG. 2), and is jetted so as to build up those regions that define the negative space 36. For example, referring to FIG. 2, for creating the letter "O" in the cliché 20, the cliché-forming material 30 would be jetted to create the central solid circular portion (shown cross-hatched as indicated at 32) and the outer periphery of the letter (shown cross-hatched as indicated at 34). This would define the open area (negative space, as indicated at 36) between the central solid circular portion and the outer periphery as the letter O.

Once the negative space 36 of the cliché 20 is created, conventional printing methods, e.g., pad printing methods, are used. That is, using an ink cup 14 or other ink delivery system, the negative space 36 is flooded with ink 12 and the cliché 20 is scraped clean such as by a doctor blade 16 on the ink cup 14. The pad 18 is then brought into contact with the cliché 20 and the ink 12 in the negative spaces 36 is transferred onto the pad 18. The pad 18 is then moved into contact with the object onto which the image is to be transferred.

Unlike known methods for creating clichés (which are subtractive processes—that is, material is removed from a plate), as set forth above, the present digitally created cliché 20 is formed by an additive process, or by depositing a cliché-forming material 30, such as a curable fluid, onto the support media 24. In a presently contemplated embodiment, the support media 24 and cliché-forming material 30 are co-engineered (custom engineered) to create a non-elastic member having high adhesion (between the cliché-forming material 30 and the media 24), and a smooth finish of the cliché-forming material 30. Preferably, the fluid or cliché-forming material 30, which is applied in a drop-on-demand type system (such as a piezo ink jet, thermal ink jet or the like), dries into a relative hard, non-absorbing state.

In a contemplated digitally created cliché 20, the cliché-forming material 30 is an energy (e.g., ultraviolet—UV) curable material. Such a material 30 can be formulated to reduce or eliminate the use of solvents necessary to carry the material, and to enable immediate or almost immediate use as a cliché surface. Other materials, such as epoxies and the like (preferably immediate or almost immediate curing) are also contemplated.

As seen in FIG. 1, in one anticipated system and method, the support medium 24 is supplied from a roll 26 and is conveyed through a jetting station 38, at which a fluid jet device 28 jets fluid/clichë-forming material 30 onto the support medium 28 in a negative of the desired image.

The support medium 24 with the deposited cliché-forming material 30 is then conveyed through a UV curing station 40 to cure the cliché-forming material 30, such as fluid, on the support medium 24. The hardened cliché-forming material 30, which is built up (additive), creates the conventional cliché 20, in that the negative spaces 36 (FIG. 2) are void spaces for receiving ink.

The cliché 20 on the support medium 24 is then transported to an ink transfer station 41 at which an ink cup 14 is moved over the cliché 20 to deposit ink 12 in the void spaces 36 and a doctor blade 16 removes or scrapes excess ink 12 from the surface of the cliché 20. Alternately, the ink cup 14 can be stationary and the cliché 20 (web) moved relative to the ink cup 14. The pad 18 is then moved into contact with the cliché 20 to transfer ink 12 onto the pad 18, which is then moved into contact with the object onto which the image is to be transferred.

Alternately, the support medium 24 can be a porous material to enable ink 12 to permeate the image area and be presented to the printing pad 18 without the surface flooding and doctoring steps.

The support media 24 can be wound onto a waste roll 42 and discarded or reused/recycled. The cliché-forming materials 30 can also be of the type to be discarded or perhaps recycled. As set forth above, the cliché 20 itself can be used for short run or single application printing runs. Due to the relatively inexpensive nature of the support media 24 and the cliché-forming material(s) 30 used, and the reduced time (labor) needed to create a cliché 20, such limited production runs can now be accomplished with the same high quality results as conventional pad printing processes.

Alternately the cliché support medium 24 can be a rigid support material, such as metal, ceramic or glass, upon which the additive process is applied to create the negative image cliché surface. In such an embodiment, the support medium 24 can be moved in a rotary fashion past the additive process, any curing process, inking/doctoring process and pad printing process. A final station can be configured to remove the additive or cliché-forming material 30 and prepare the surface for a new application of or cliché-forming material 30 to define a new image.

By the present method, the additive cliché manufacturing process 10 can be used to create a unique image for each cycle of the printing system. Of course, each image can be used to decorate several items in succession before presenting a new image for printing.

It will be appreciated that one or more fluid jetting devices 28 can be used to apply the cliché-forming material 30 to the support media 24 to effect an efficient process. It will also be understood from the description above that the various components, e.g., the fluid jetting device(s) 28, fluid jetting station 38, the curing station 40, the ink transfer station 41, and the like, can be separate from one another by space, by shrouds 44, or by other separating means as required. Given that space is often at a premium and most machines are designed with the smallest practical footprint, it is envisioned that partitions and/or shrouds 44 will be used to separate the stations 38, 40, 41 as necessary.

It will also be appreciated that any additive type of additive process can be used to create the cliché 20. For example, currently known (and to be developed) 3-D printing technologies, rapid prototyping technologies, other additive manufacturing processes can be used to create the cliché surface. To this end, the material can be jetted or, if solid or powdered, deposited onto the support media and allowed to harden (generally cure), for use. It is preferred that curing occurs immediately or almost immediately so as to provide an efficient printing process.

All patents referred to herein, are incorporated herein by reference, whether or not specifically done so within the text of this disclosure.

In the disclosure, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A digital cliché pad printing system comprising:

a conveyor for conveying a substantially non-elastic, elongate, continuous flexible support member, the support member formed from a paper tape, foil or polymeric material;

a fluid jetting device for depositing a UV curable fluid onto the continuous support member in a desired pattern, the UV curable fluid adhered to the continuous support member, the desired pattern having at least one void space, the at least one void space having a shape defining a desired graphic to be transferred to an object;

a UV energy source for curing the fluid in the desired pattern, the cured fluid defining a cliché having a top surface;

an ink delivery system for depositing ink in the at least one void space and for wiping ink from the top surface; and a pad configured to contact the cliché and receive the ink from the void space, the received ink forming the desired graphic to be transferred, the pad further configured to move into contact with the object and transfer the desired graphic to the object, wherein the conveyor conveys the continuous support member from the fluid jetting device to the pad, through the UV energy source and the ink delivery system.

2. The digital cliché pad printing system in accordance with claim 1 including a controller for controlling the deposition device.

3. The digital cliché pad printing system in accordance with claim 1 including a dispenser for dispensing the continuous support member and a take up for taking up the continuous support member following printing.

4. The digital cliché pad printing system in accordance with claim 1 wherein the ink delivery system includes an ink cup and a doctor blade for delivering ink to the cliché and depositing ink in the at least one void space, and for wiping excess ink from the cliché.

5. A method for pad printing comprising the steps of:

dispensing a substantially non-elastic, elongate, continuous flexible support member from a dispenser along a conveyance path, the support member formed from a paper tape, foil or polymeric material;

depositing a UV curable fluid onto the continuous support member, the UV curable fluid deposited in a desired pattern, adhered to the continuous support member, and defining at least one void space, the at least one void space having a shape defining a desired graphic to be transferred to an object;

subjecting the UV curable fluid to UV energy to cure the fluid to define a cliché having a top surface;

filling the at least one void space with an ink and wiping ink from the top surface of the cliché;

contacting a printing pad with the cliché to receive the ink on the printing pad from the void space, the received ink forming the desired graphic to be transferred; and contacting the printing pad with the object to transfer the desired graphic from the printing pad to the object, wherein a conveyor conveys the continuous support member along the conveyance path from the dispenser through the step of contacting the printing pad with the object.

6. The method for pad printing in accordance with claim 5 wherein the UV curable fluid is deposited by jetting the fluid onto the support member.

7. The method for pad printing in accordance with claim 5 including the step of winding the support element following the step of contacting the printing pad with the cliché to transfer the ink form the void space to the printing pad.

* * * * *